US006237389B1

(12) United States Patent
Tada et al.

(10) Patent No.: US 6,237,389 B1
(45) Date of Patent: May 29, 2001

(54) APPARATUS AND METHOD FOR FORMING SCREW-THREAD ON A PIPE

(75) Inventors: Minoru Tada; Mikio Morinaga, both of Mie (JP)

(73) Assignee: Bestex Kyoei Co., Ltd., Mie (JP)

( * ) Notice: Subject to any disclaimer, the term of this patent is extended or adjusted under 35 U.S.C. 154(b) by 0 days.

(21) Appl. No.: 09/417,972

(22) Filed: Oct. 13, 1999

(30) Foreign Application Priority Data

May 27, 1999 (JP) ..... 11-147806

(51) Int. Cl.[7] ..... B21D 31/06

(52) U.S. Cl. ..... 72/402; 72/403; 72/367.1; 72/370.21

(58) Field of Search ..... 72/402, 370.19, 72/370.21, 367.1, 379.4, 353.4, 354.6, 403; 413/23, 56

(56) References Cited

U.S. PATENT DOCUMENTS 3,382,699 * 5/1968 Seeman ..... 72/353.4
4,416,142 * 11/1983 Thorne-Thomsen ..... 72/353.4

FOREIGN PATENT DOCUMENTS

144361 * 6/1931 (CH) ..... 72/402
453363 * 12/1927 (DE) ..... 72/353.4
10430 * 3/1974 (JP) ..... 73/402
61-253140 11/1986 (JP) .
1486256 * 6/1989 (RU) ..... 72/402

* cited by examiner

*Primary Examiner*—Daniel C. Crane
(74) *Attorney, Agent, or Firm*—Merchant & Gould P.C.

(57) ABSTRACT

In an apparatus and a method for forming threaded portions around a metal pipe with accuracy and ease, a preliminary forming is performed so as to recess portions of the metal pipe a little bit inwardly in the radial direction thereof by advancing auxiliary forming punches while keeping main forming punches as they are. Thereafter, by receding the auxiliary forming punches back, while advancing the main forming punches, simultaneously, the threaded portions are formed on outer periphery of the metal pipe 3 shifted by 180° in phase thereof.

5 Claims, 8 Drawing Sheets

PRIOR ART

APPARATUS AND METHOD FOR FORMING SCREW-THREAD ON A PIPE

BACKGROUND OF THE INVENTION

1. Field of the Invention

The present invention relates to an apparatus for forming a screw-thread(s) on or around a metal pipe (such as a steel pipe) and a method for forming the screw-thread(s) on or around the metal pipe using such an apparatus, and further relates to a fuel supplying pipe assembly being assembled with the metal pipe, on which is formed the screw-thread(s) being obtained by the described screw-thread forming apparatus and method therefor.

2. Description of Prior Art

Conventionally, a roll forming method and a punch forming method are known for forming a screw-thread(s) on a metal pipe.

In the roll forming method, as shown in FIG. 11(*a*), a metal pipe 101 is introduced to cover on a core metal 100, around which is formed a forming groove 100*a*, and as shown in FIG. 11(*b*), a protruded or convex forming portion 102*a* of a forming roller 102 is pushed on the metal pipe 101 when the metal pipe 101 begins rotation together with the core metal 100, so as to deform a threaded portion 103 following the forming groove 100*a*.

On the other hand, the present invention can be classified as a punch forming method, and one such method is already known as is disclosed in Japanese Laid-Open Patent No. Sho 61-253140 (1986).

Namely, as shown in FIG. 12(*a*), a plurality of forming punches 104 are provided, each having a forming edge portion 104*a* of curvature corresponding to that of the concave portion of the desired screw-thread, being freely movable in a direction toward one point (i.e., a central portion of a set) back and forth, and a metal pipe 101 is set or fixed at the center of the plural forming punches 104. Then, the plural forming punches 104 are shifted toward the central portion of the set to give pressure on the metal pipe 101 at the forming edge portion 104*a* of the punches, thereby forming the threaded portion by deforming the pipe 101 plastically.

In the roll forming method, pressure is applied to the metal pipe at the summit of the convex forming portion 102*a* of the forming roller so as to perform machining plastically with continuity. In other words, the summit of the convex forming portion 102*a* and the metal pipe 101 are in contact with each other under a condition of point contact or a form of contact similar thereto, as can be seen from FIG. 11(*b*), especially in a direction C thereof. Therefore, the material is extended (deformed) only in the portion where the summit of the convex forming portion 102*a* contacts with it, and the threaded portion is formed by the material being extended. As a result of this, the threaded portion is extremely reduced in the thickness thereof.

It is noted that the roll forming method is not appropriate in particular in a case when forming double threading, or wherein the threaded portions are not formed more than one turn around the outer periphery of the pipe (i.e. wherein threaded length-wise portions of the pipe 3 are formed, the threads not being physically continuous on the circumference of the pipe 3).

On the other hand, in the punch forming method, the curvature of the thread-forming portion of the forming punch is set to be equal to that of the convex curvature of the threaded portion to be formed, but it is smaller than that of the outer periphery on the metal pipe before the forming thereof. Therefore, as shown in FIG. 12(*b*), in initial steps of the machining process, the forming punches abut on the outer periphery of the metal pipe only at both ends p of each forming portion 104*a* thereof, and the forming is started from those portions. The material between the forming punches is not moved nor extended into such direction that it forms the threaded portion, however, as shown in FIG. 12(*c*), it rather extends or bulges outward in the radial direction.

And, as the material of the portion being expanded outward is finally protruding among or between the forming punches, it is therefore impossible to form the threaded portion uniformly.

SUMMARY OF THE INVENTION

According to the present invention, for solving such problems as mentioned above there is provided an apparatus for forming a screw thread on a metal pipe, comprising:

a plurality of main forming punches, being disposed radially with respect to a center of the metal pipe which is set therein, and being movable back and forth in a direction to the center of the metal pipe; and a plurality of auxiliary forming punches being disposed between or among said plurality of main forming punches, wherein a pit forming portion in each of said plurality of main forming punches is made equal to the concave portion of the screw-thread to be formed in the radius of the curvature thereof, and said plurality of auxiliary forming punches are made smaller than said plurality of main forming punches in sizes along with outer periphery of the metal pipe, as well as movable back and forth independent upon from said main forming punches.

Further, in a case where, for example, double screw-threads are formed by use of the screw-thread forming apparatus mentioned above said main forming punches are provided four (4) in number thereof, and said auxiliary forming punches are provided two (2) in number thereof, being disposed between a pair of said main forming punches among said four (4) main forming punches.

Also, in a case of forming the screw-thread by use of the screw-thread forming apparatus as described in the above, a forming method is disclosed, comprising the following steps of:

setting a metal pipe at a center of the plurality of main forming punches in a condition of being open;

confronting auxiliary forming punches between main forming punches at a same time of said setting step;

performing preliminary forming with said auxiliary forming punches; and thereafter, forming the screw-thread by moving said main forming punches to shrink in the diameter thereof.

In this manner, by recessing inwardly the portions which would otherwise be extended outwardly according to the conventional art, prior to the forming by means of the main forming punches, it is possible to make the projections occurring between or among the main forming punches as small as possible.

As another method for forming a screw-thread on the metal pipe by using the apparatus for forming a screw-thread as described in the above, according to the present invention, there is provided a method, comprising the following steps of:

setting a metal pipe at the center of the plurality of main forming punches in a condition of being open;

confronting the auxiliary forming punches disposed between the main forming punches at a same time of said setting step;

forming a convex portion of the screw-thread to a certain extent, by suppressing the tip forming portions of said main forming punches and said auxiliary forming punches on outer periphery of the metal pipe, as well as advancing said main forming punches and said auxiliary forming punches at the same time; and thereafter, forming the screw-thread into a final shape thereof only by the action of said main forming punches while receding said auxiliary forming punches back from the screw-thread.

Also, it is possible to achieve a fuel supply pipe assembly by combining a cap together with a metal pipe on which are formed the double screw-threads, being obtained by the screw-thread forming apparatus and the forming method according to the present invention.

In this instance, by selecting an inclination angle of the double screw-threads, it can be so structured that the cap Is closed completely when it rotates less than 360° or 180° in rotation angle and a handle begins to run idle at this time point due to the function of an idling mechanism.

DETAILED DESCRIPTION OF PREFERRED EMBODIMENTS

Figure 1:
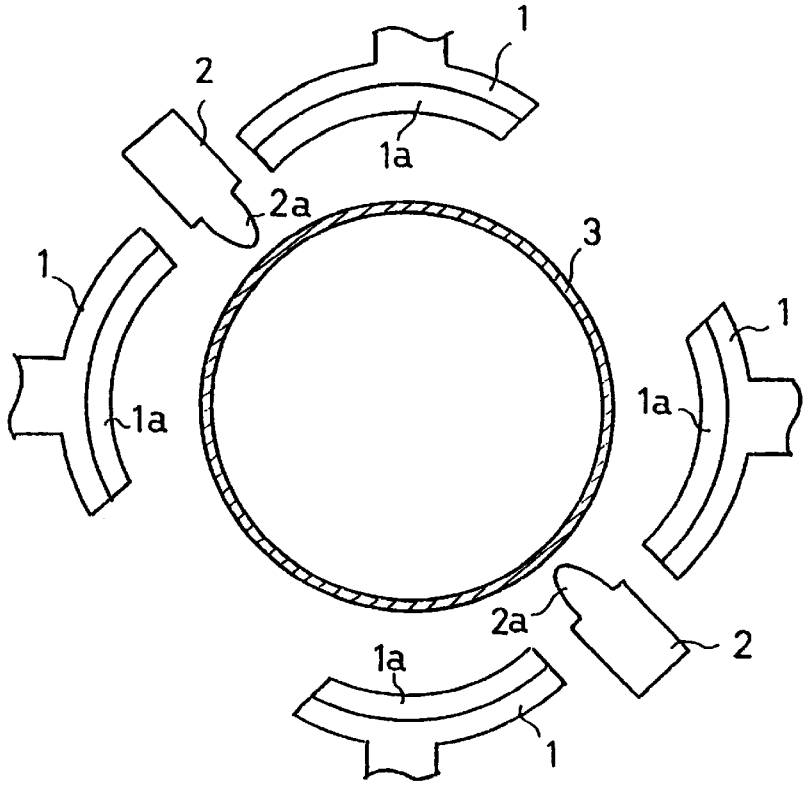
FIG. 1 is a view showing a screw-thread forming apparatus according to the present invention, in particular showing the condition before the forming operation thereof.
Figure 2:
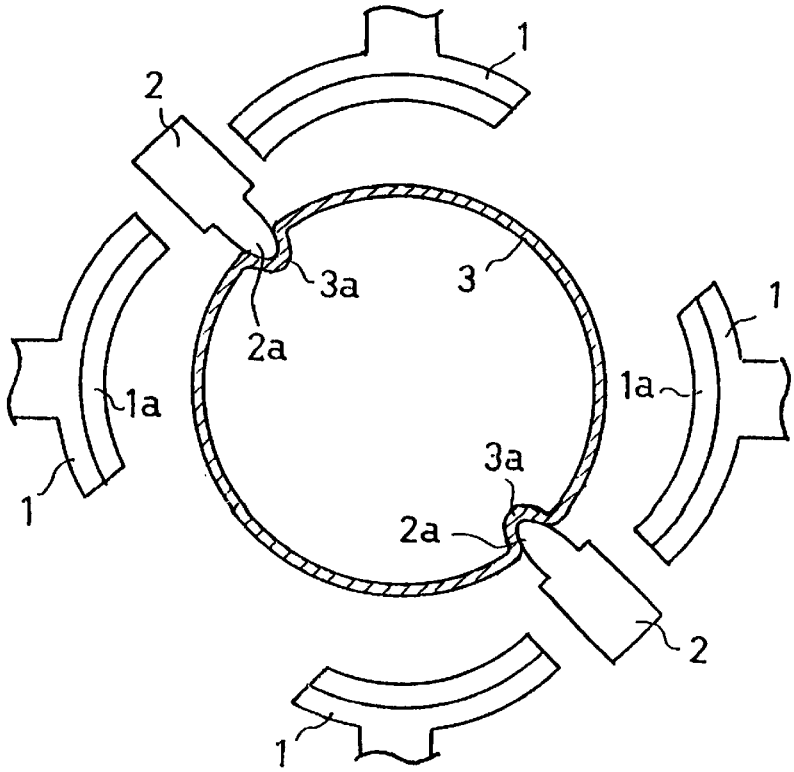
FIG. 2 is a view showing the same screw-thread forming apparatus in the condition during the forming operation thereof.
Figure 3:
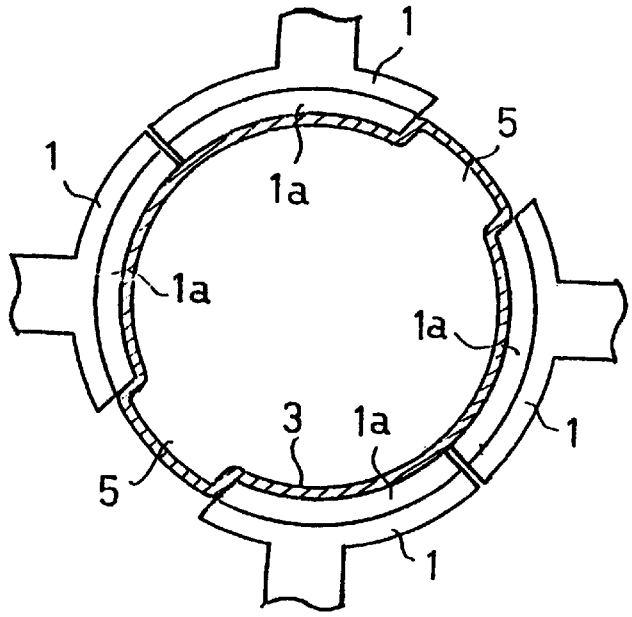
FIG. 3 is a view showing the same screw-thread forming apparatus in the condition when completing the forming operation thereof.
Figure 4:
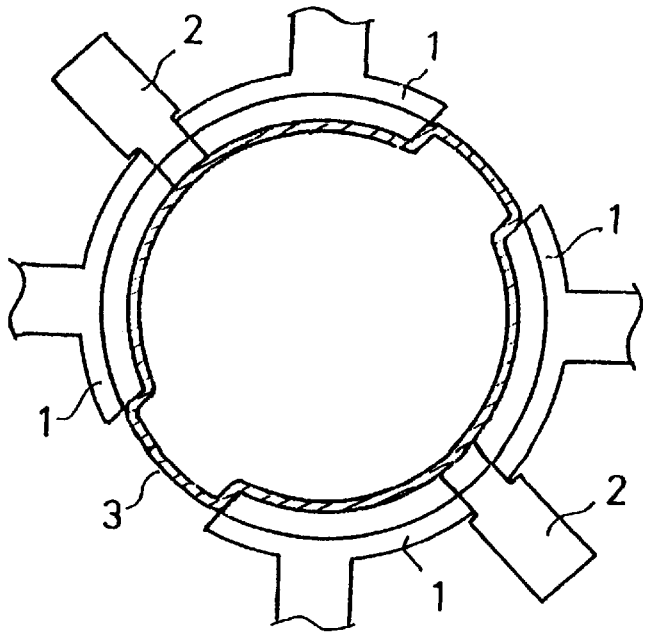
FIG. 4 is a view for explaining a forming method according to another embodiment of the present invention, in a manner similar to that in FIG. 2.
Figure 5:
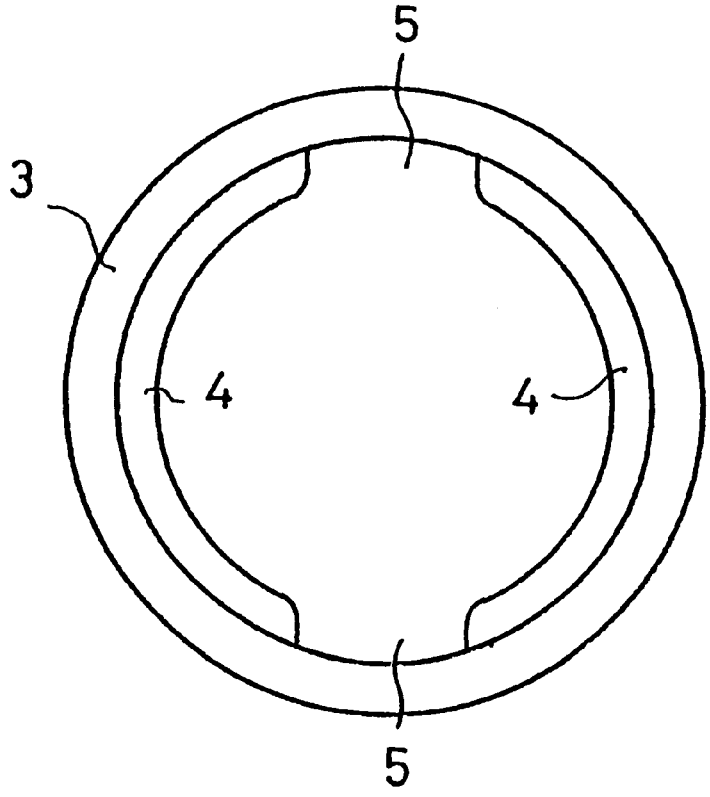
FIG. 5 is a plain view of a pipe on which is formed double screw-threads obtained according to the present invention.
Figure 6:
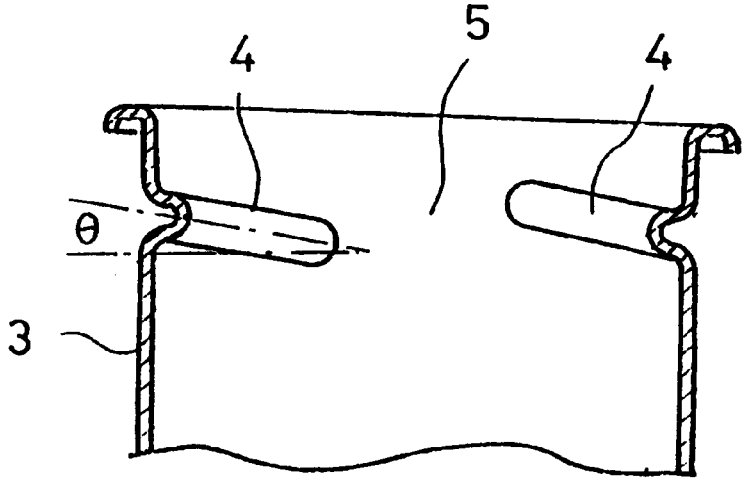
FIG. 6 is a vertical cross-sectional view of the pipe on which is formed the double screw-threads.

Hereinafter, embodiments according to the present invention will be fully explained by referring to the attached drawings, wherein, FIG. 1 is a view of showing a screw-thread forming apparatus according to the present invention, in particular in the condition before the forming operation thereof; FIG. 2 is a view of showing the same screw-thread forming apparatus in the condition during the forming operation thereof; FIG. 3 is a view of showing the same screw-thread forming apparatus in the condition when completing the forming operation thereof; FIG. 4 is a view for explaining a another forming method, according to another embodiment of the present invention, in a manner similar to that in FIG. 2; FIG. 5 is a plain view of a pipe on which is formed double screw-threads obtained according to the present invention; and FIG. 6 is a vertical cross-sectional view of the pipe on which is formed the double screw-threads.

The screw-thread forming apparatus for forming double screw-threads on a metal pipe, as shown in the figure, comprises main forming punches 1 and auxiliary forming punches 2.

The main forming punches 1 are disposed four in number thereof in the present embodiment, however, the number can be any other arbitrarily. The main forming punches 1 are movable back and forth toward a center of the metal pipe 3 which is set at a forming position, wherein the radius of curvature at each thread-forming portion 1*a* thereof is selected to be equal to that at a concave portion of the screw-thread to be formed therewith.

The main forming punches 1 are in a condition of being open when they are away from the center, while they are in a closed condition when the main forming punches 1, forming a pair or group with one another, are moved toward the center so as to abut on one another at the ends thereof.

The auxiliary forming punches 2 are disposed between the main forming punches 1 forming opposing pairs, receptively. Those auxiliary forming punches 2 are also movable back and forth but independent from the main forming punches 1, and a forming (tip) portion 2*a* of each is rounded in shape.

Further, in the example shown in the figure, for the purpose of forming the double screw-threads, each of the auxiliary forming punches 2 is provided only between the main forming punches 1 together comprising the pair being opposite to another pair of punches but not between the forming punches 1 which do not form the pair. However, in the case of forming a normal spiral screw-thread, the auxiliary forming punches 2 are disposed among each of main forming punches 1. Further, in the case of forming the normal spiral screw-thread, a plurality of forming portions 1*a* are provided on each main forming punch 1 at a predetermined pitch therebetween. However, the plurality of forming portions 1*a* are shown lying on top of one other in the direction being vertical to the surface of the figure.

Also, mechanisms for back and forth moving of the main forming punches 1 and the auxiliary forming punches 2 back and forth are known means, such as a fuel pressure cylinder unit, etc., not shown in the figure.

For forming the double screw-threads on or around the metal pipe 3 with use of the screw-thread forming apparatus mentioned above, first of all, the auxiliary forming punches 2 are advanced from the condition shown in FIG. 1, while leaving the main forming punches 1 as they are, so as to perform a preliminary forming in which a portion 3*a* of the metal pipe 3 is slightly recessed in the radial direction thereof (toward the center of the radius thereof).

Thereafter, as shown in FIG. 3, the auxiliary forming punches 2 are moved back or receded and at the same time the main forming punches 1 are moved ahead or advanced, thereby forming the threaded portions (screw-threaded portions of pipe 3) 4 and 4 on the outer periphery of the metal pipe 3 with shifting 180° in the phase thereof, as shown in FIGS. 5 and 6.

In the present embodiment, unfinished portions 5, 5 remain between each end of the threaded portions 4 and 4, respectively.

However, in the process of the forming, as shown in FIG. 4, it is also possible to form the concave portion of the screw-thread to a certain extent by advancing both the main forming punches 1 and the auxiliary forming punches 2 simultaneously, and thereafter, only the auxiliary forming punches 2 are receded while advancing the main forming punches 1 further, thereby forming the screw-thread into the final shape thereof.

Figure 7:
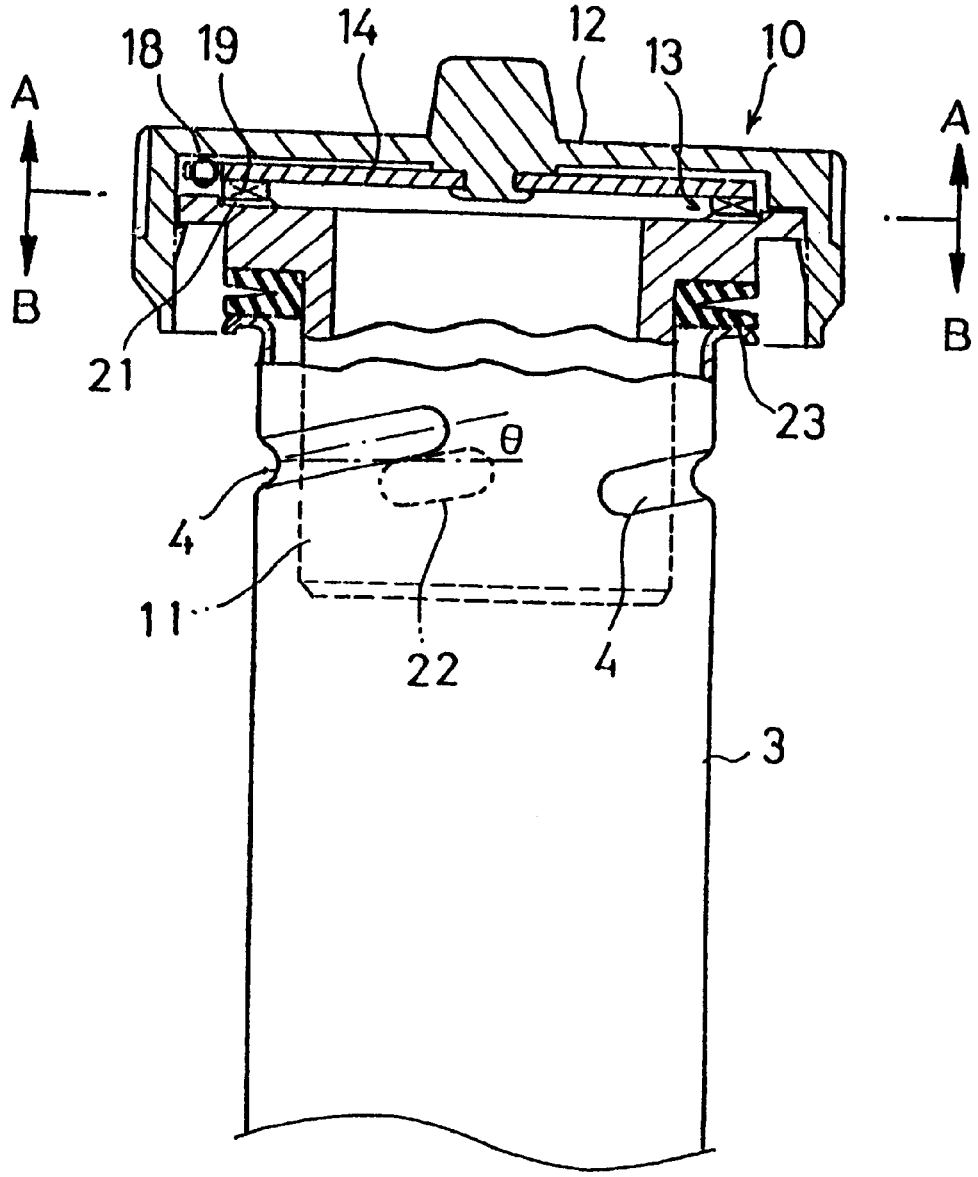
FIG. 7 is a cross-sectional view of a fuel supply pipe assembly formed with a cap and the double screw-threads which are obtained according to the present invention.
Figure 8:
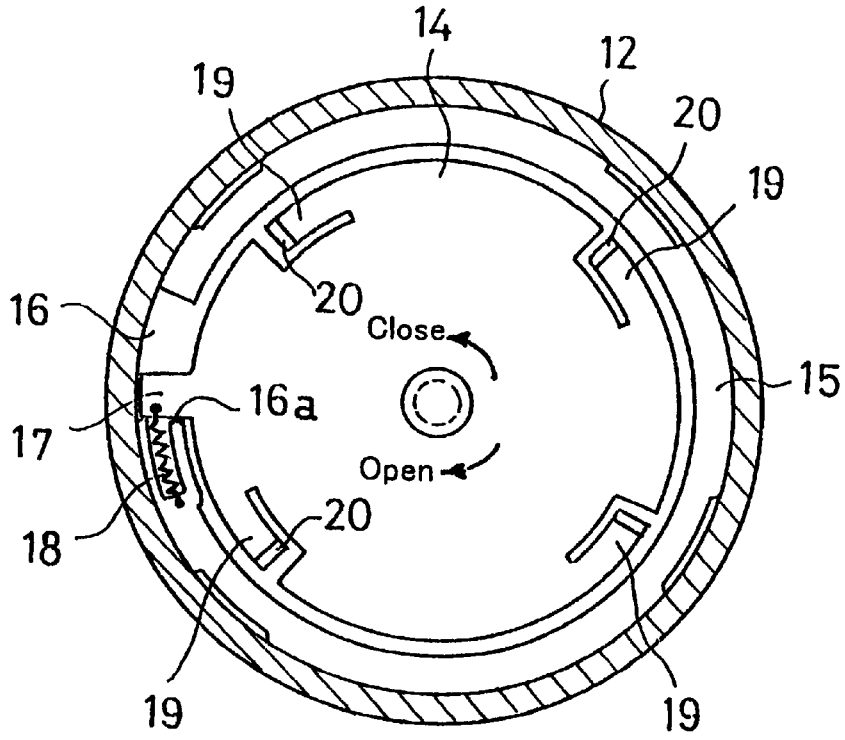
FIG. 8 is a view of the cap taken in the direction indicated by arrows A—A in FIG. 7.
Figure 9:
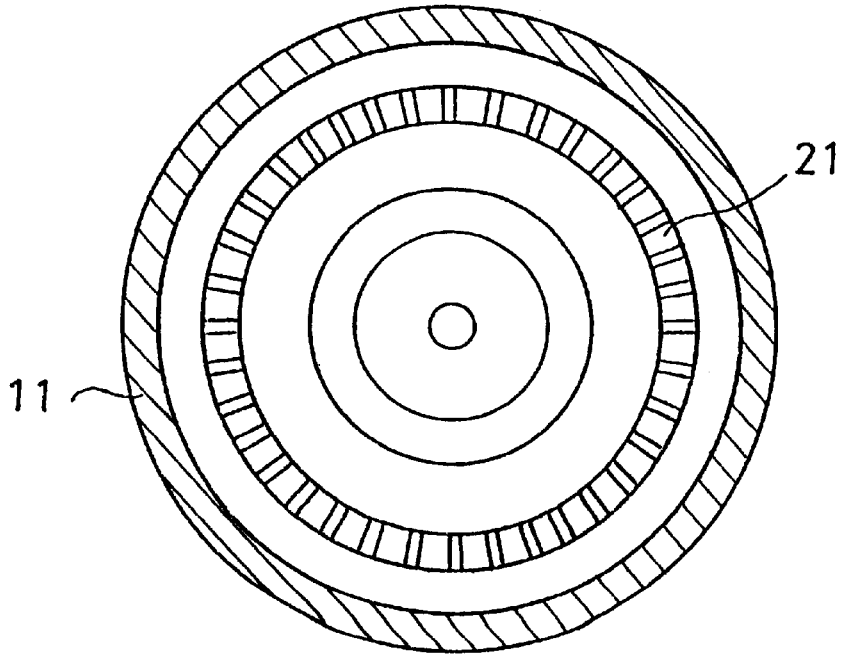
FIG. 9 is a view of the cap taken in the direction indicated by arrows B—B in FIG. 7.

FIG. 7 shows a cross-sectional view of a fuel supplying assembly assembled with a cap 10 and the metal pipe 3 having the double screw-threads thereon, which are formed by the above-mentioned method according to the present invention. FIG. 8 is a view taken in the direction indicated by arrows A—A in FIG. 7, and FIG. 9 is a view taken in the direction indicated by arrows B—B in FIG. 7.

The fuel supplying assembly according to the present invention comprises the metal pipe 3 and the cap 10, wherein the above-mentioned threaded portions 4 and 4 are formed on the metal pipe 3, and further the cap 10 comprises an insertion portion 11, a handle portion 12 and an idling mechanism 13 which makes the handle portion 12 run idle with respect to the insertion portion 22 when a predetermined force is applied thereto.

On the reverse side of the handle 12 mentioned above, a middle plate 14 is fixed rotatably. On an outside of the middle plate 14 on the reverse side of the handle 12 is fixed a circular limit member 15, and further a convex portion 17 of the above middle plate 14 is located at a cutoff portion 16 of the circular limit member 15.

Therefore, the middle plate 14 is rotatable within a region where the convex portion 17 can be shifted within the cutoff portion 16 of the circular limit member 15. However, in the present embodiment, the convex portion 17 is biased by means of a spring 18 so that it touches on the cutoff portion 16 at one end thereof.

Also, with forming a cut portion of a "L" shape on the outer periphery of the middle plate 14, an elastic stopper piece 19 is provided therein, thereby forming a hook 20 at the tip of this elastic stopper piece 19.

A concave and convex portion 21 of a saw tooth-like shape is formed on the portion opposing the above-mentioned elastic stopper piece 19 of insertion portion 11.

Further, on a side surface of the insertion portion 11 are formed convex portions 22 for hooking them on the above threaded portion 4.

However, the idling mechanism 13 should not limited only to such the structure as mentioned above, but also it may be structured by forming the middle plate 14 on the side of the insertion portion 11 while the saw tooth-like concave and convex portions 21 are formed on the reverse side surface of the handle 12.

In the above, for closing the cap 10 completely, first letting the convex portions 22 which are formed on the side surface of the insertion portion 11 pass through the unfinished portion 5 defined between the threaded portions 4 and 4, the cap 10 is inserted into the metal pipe 3, and then the handle is rotated in a clockwise direction. It is noted, however, that FIG. 8 is a view showing the handle from a lower position, therefore in this figure, an anti-clockwise direction is that for closing the cap.

Next, since the convex portions 22 abut on the belly of the threaded portions 4, the cap 10 enters into the metal pipe 3 while shifting along the inclination of the threaded portions 4, there by pushing a packing 23 toward the open end of the metal pipe 3.

Figure 10:
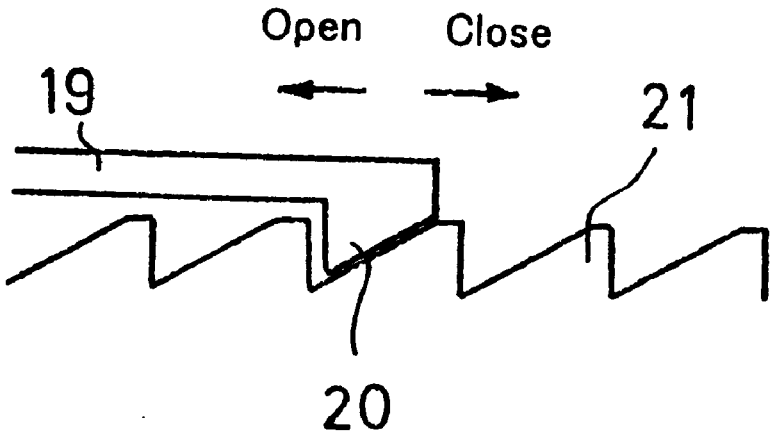
FIG. 10 is a view for explaining the function of an idling mechanism of the cap.
Figure 11:
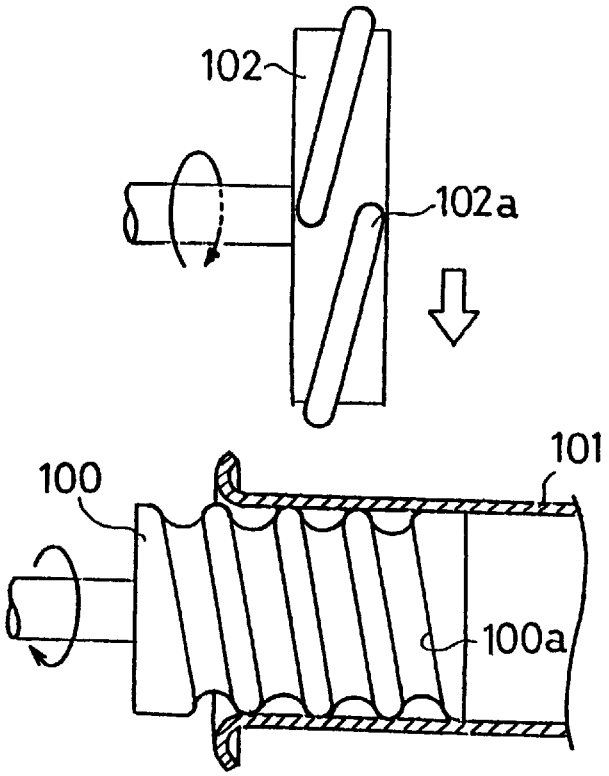
FIG. 11 (a) PRIOR ART
FIGS. 11(*a*) and (*b*) are views for explaining a roll forming method according to the conventional art.
Figure 11:
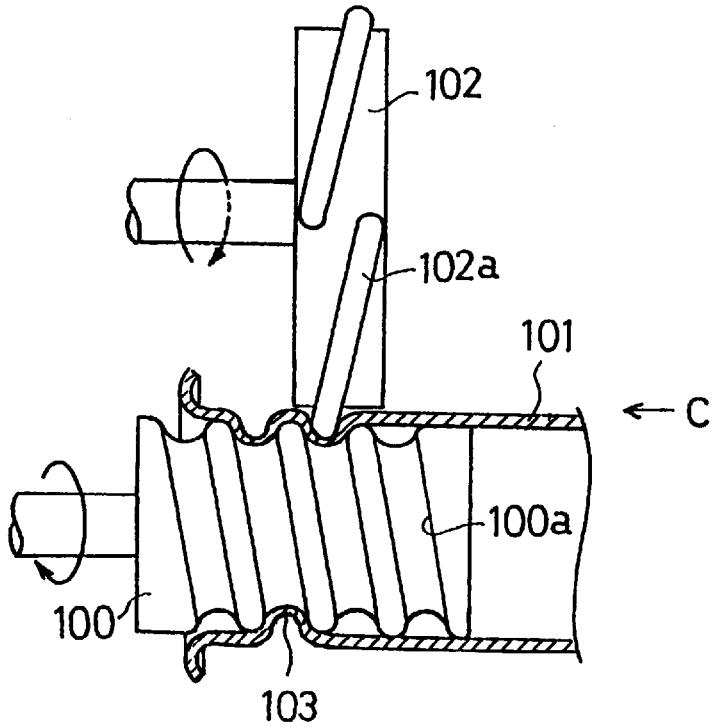
Figure 12:
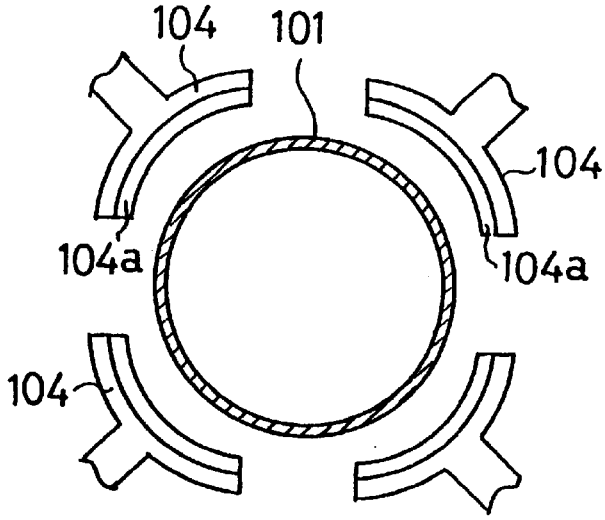
PRIOR ART FIG. 12 (a)
FIGS. 12(*a*) to (*c*) are views for explaining a punch forming method according to the conventional art.
Figure 12:
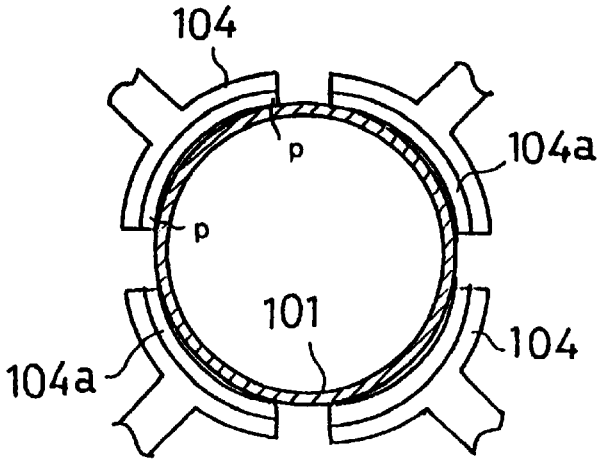
PRIOR ART FIG. 12 (b)
Figure 12:
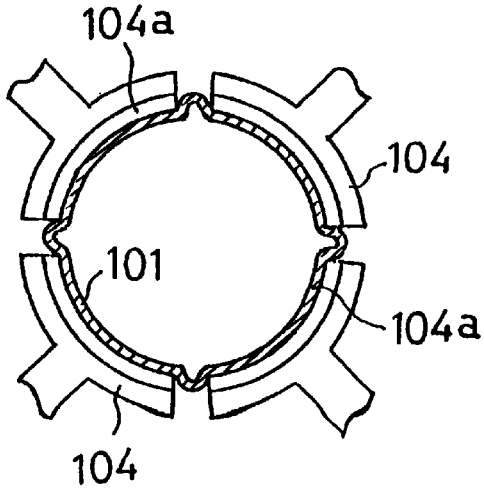
PRIOR ART FIG. 12 (c)

When the force pushing down the packing 23 is great enough to ensure airtightness therethrough, a resistance becomes large against the rotation of the cap 10. Then, as shown in FIG. 10, the elastic stopper piece 19 is deformed upwardly, and the tip of the hook 20 climbs over the saw tooth-like concave and convex portion 21, thereby causing the portion of the handle to run idle with respect to the insertion portion 11.

By the clicking sound or action occurring in this instance, a user can notice with ease the completion of the closing operation of the cap.

In the present embodiment, by selecting the inclination angle θ of the threaded portions 4 appropriately, the closure of the cap 12 is completed when the handle 12 is rotated by a half-turn (180°) or a quarter-turn (90°).

In explanation, if the inclination angle θ of the threaded portions 4 is too small, the handle will not come into the idling condition when rotating it more than one round, while contrarily if it is too large the handle 4 is brought into the idling condition by rotating it a little bit but comes off easily as only a small portion of threaded contact is employed. Accordingly, it is important to select the inclination angle θ at an appropriate angle.

The angle may be selected so that the closure is completed when the handle 12 is rotated by up to one-turn (360°), if the purpose is to prevent the user from forgetting to close the cap.

When external force is applied to the handle 12 in the open direction after completing the closure thereof, the middle plate 14 is rotated in that direction (i.e., the anti-clockwise direction in FIG. 8), thereby making possible loosening of the cap.

However, according to the present embodiment, in the case where the external force is applied to the handle 12 in the open direction, only the handle 12 is rotated in the anti-clockwise direction against the spring 18 while the middle plate 14 remains as it is, therefore there is no chance that the cap 10 is loosened.

When the user intends to take off the cap, he must rotate it by making an end 16*a* of the cutoff portion 16 push on the convex portion 17 of the middle plate 14.

As is fully explained in the above, according to the present invention, in the method for forming the threaded portion(s) on the metal pipe by using the plurality of main forming punches, portions are formed preliminarily by the auxiliary forming punches, in particular on the outer periphery surface of the metal pipe which are located between or among the plurality of the main forming punches when forming it, in advance of or at the same time as forming by the main forming punches, so as to recess the portions located between or among the plurality of the main forming punches inwards in the radial direction, thereby enabling the forming of a uniform threaded portion without clipping or pinching the material between the main forming punches.

Showing in more detail with numerical values thereof, in a case where the threaded portions are formed with 4.0 mm in width between the convex (or concave) portions thereof and with 3.18 mm in height thereof, the sizes of the convex portions are equal or less than 0.5 mm in width and equal or less than 0.2 mm in height, being left after the forming process of the portions where they are located between the main forming punches in the initial steps thereof. Accordingly, they cause no problem with the function of the threaded portions thereof.

In particular, by forming the threaded portion not on the article formed of resin material but that of the metal, the strength or durability can be improved greatly, such as against cracking and damage thereof.

Further, with the fuel supply pipe assembly in the conventional art, since the closure of the cap is so designed to be completed by turning it two or three-turns, it sometimes happens that the closure is still incomplete although the user believes the closure to have been properly completed. However, with the fuel supply pipe assembly according to the present invention, the cap can be closed with the predetermined sealing force by turning it within one-turn, thereby dissolving a chance of incomplete closure as may be caused by a user forgetting the necessary number of turns of the cap for proper, sealed closure.

What is claimed is:

1. An apparatus for forming a screw-thread on a metal pipe, comprising:

a plurality of main forming punches adapted to be distributed about an outer periphery of the metal pipe, each of said main forming punches comprising at least one thread forming portion having a radius of curvature substantially equal to a radius of curvature of the screw-thread to be formed, said main forming punches being radially movable with respect to the center of the metal pipe between an open position and a closed position, said at least one thread forming portion of each said main forming punch being adapted to engage the outer periphery of the pipe so as to form the screw-thread when said main forming punches are in said closed position; and a plurality of auxiliary forming punches adapted to be distributed about the outer periphery of the pipe, said auxiliary forming punches being interspersed among said main forming punches, said auxiliary forming punches extending a smaller distance than said plurality of main forming punches along an outer periphery of the metal pipe, each of said auxiliary forming punches comprising at least one forming portion, said auxiliary forming punches being radially movable with respect to a center of the metal pipe between an open position and a closed position independently from said main forming punches, said at least one forming portion of each said auxiliary forming punch being adapted to engage the outer periphery of the pipe so as to at least partially form the screw-thread when said auxiliary forming punches are in said closed position.

2. An apparatus for forming a screw-thread as described in claim 1, comprising four main forming punches, and two auxiliary forming punches, each of said auxiliary forming punches being disposed between a pair of said main forming punches, said apparatus thereby being adapted to form circumferentially separate screw-thread portions.

3. A method for forming a screw-thread on a metal pipe, comprising the steps of:

distributing a plurality of main forming punches radially about an outer periphery of the metal pipe, each of said main forming punches comprising at least one thread forming portion having a radius of curvature substantially equal to a radius of curvature of the screw-thread to be formed, said main forming punches being radially movable with respect to a center of the metal pipe between an open position and a closed position, said at least one thread forming portion of each said main forming punch being adapted to engage the outer periphery of the pipe when said main forming punches are in said closed position, said main forming punches being in said open position;

distributing a plurality of auxiliary forming punches about the outer periphery of the metal pipe, said auxiliary forming punches being interspersed among said main forming punches, said auxiliary forming punches extending a smaller distance than said plurality of main forming punches along the outer periphery of the metal pipe, each of said auxiliary forming punches comprising at least one forming portion, said auxiliary forming punches being radially movable with respect to the center of the metal pipe between an open position and a closed position independently from said main forming punches, wherein said at least one forming portion of each said auxiliary forming punch is adapted to engage the outer periphery of the pipe when said auxiliary forming punches are in said closed position, said auxiliary forming punches being in said open position;

moving said auxiliary forming punches toward said closed position so as to secure the pipe in place;

moving said auxiliary forming punches to said closed position so as to partially form the screw-thread position so as to partially form the screw-thread moving said main forming punches to said closed position so as to form the screw-thread.

4. A method for forming a screw-thread on a metal pipe, comprising the steps of:

distributing a plurality of main forming punches radially about an outer periphery of the metal pipe, each of said main forming punches comprising at least one thread forming portion having a radius of curvature substantially equal to a radius of curvature of the screw-thread to be formed, said main forming punches being radially movable with respect to a center of the metal pipe between an open position and a closed position, said at least one thread forming portion of each said main forming punch being adapted to engage the outer periphery of the pipe when said main forming punches are in said closed position, said main forming punches being in said open position;

distributing a plurality of auxiliary forming punches about the outer periphery of the metal pipe, said auxiliary forming punches being interspersed among said main forming punches, said auxiliary forming punches extending a smaller distance than said plurality of main forming punches along the outer periphery of the metal pipe, each of said auxiliary forming punches comprising at least one forming portion, said auxiliary forming punches being radially movable with respect to the center of the metal pipe between an open position and a closed position independently from said main forming punches, wherein said at least one forming portion of each said auxiliary forming punch is adapted to engage the outer periphery of the pipe when said auxiliary forming punches are in said closed position, said auxiliary forming punches being in said open position;

moving said auxiliary forming punches toward said closed position so as to secure the pipe in place;

moving said main forming punches and said auxiliary forming punches toward said closed position simultaneously so as to partially form the screw-thread; and moving said main forming punches to said closed position so as to form the screw-thread while moving said auxiliary forming punches to said open position.

5. A method for forming a screw-thread as described in claim 3, wherein the screw thread comprises double screw-thread portions separated circumferentially from each other by 180°.

* * * * *